US008465099B2

(12) United States Patent
Addy

(10) Patent No.: US 8,465,099 B2
(45) Date of Patent: Jun. 18, 2013

(54) SEATING DEVICE

(75) Inventor: Stephan George Ayikwei Addy, Kassel (DE)

(73) Assignee: Stephan George Ayikwei Addy, Kassel (DE)

( * ) Notice: Subject to any disclaimer, the term of this patent is extended or adjusted under 35 U.S.C. 154(b) by 188 days.

(21) Appl. No.: 13/109,746

(22) Filed: May 17, 2011

(65) Prior Publication Data

US 2011/0285188 A1 Nov. 24, 2011

(30) Foreign Application Priority Data

May 18, 2010 (DE) ..... 10 2010 022 150

(51) Int. Cl.
*A47C 7/50* (2006.01)
*A47C 7/52* (2006.01)

(52) U.S. Cl.
USPC ..... 297/423.11; 297/423.12

(58) Field of Classification Search
USPC ..... 297/423.11, 423.12
See application file for complete search history.

(56) References Cited

U.S. PATENT DOCUMENTS 3,541,313 A * 11/1970 Buzzi ..... 297/423.11 X
3,669,493 A * 6/1972 Vowles ..... 297/423.11
RE28,038 E * 6/1974 Buzzi ..... 297/423.11 X
3,863,978 A * 2/1975 Gillings, Jr. ..... 297/423.11 X
4,534,590 A * 8/1985 Yamamura et al. .. 297/423.11 X
4,589,699 A * 5/1986 Dungan ..... 297/423.12
4,772,071 A * 9/1988 Richards ..... 297/423.12
5,642,535 A * 7/1997 Frawley et al. ..... 4/559
5,865,507 A * 2/1999 Earl, Jr. ..... 297/423.11
5,882,081 A * 3/1999 Earl, Jr. ..... 297/423.11
5,983,418 A * 11/1999 Goodman et al. ... 297/423.11 X
RE37,346 E * 9/2001 Frawley et al. ..... 4/559
7,070,241 B2 * 7/2006 Saulnier et al. ..... 297/423.12
7,152,919 B2 * 12/2006 Wurzelbacher et al. . 297/423.11 X
7,320,502 B1 * 1/2008 McCloskey ..... 297/423.11
7,856,679 B1 * 12/2010 Finell ..... 297/423.11 X
2003/0127900 A1 * 7/2003 Chen ..... 297/423.11
2012/0074753 A1 * 3/2012 Kalayjian ..... 297/423.11

* cited by examiner

*Primary Examiner* — Rodney B White
(74) *Attorney, Agent, or Firm* — Henry M. Feiereisen LLC; Ursula B. Day

(57) ABSTRACT

A seating device is proposed for a person sitting in an ergonomic position helpful to relieve pressure on intervertebral disks, which includes a seating surface for supporting the buttocks of the person and where the instep of the person's feet is placed on a foot rest provided. The seating surface is supported by at least one U shaped support which includes a rocker by which the seated person can tilt the seating surface into the most comfortable and ergonomic position. The foot rest is divided into two partial sections which flank the support and which are connected by connecting means so that the rocking motion of the support can proceed unencumbered.

5 Claims, 8 Drawing Sheets

SEATING DEVICE

CROSS-REFERENCES TO RELATED APPLICATIONS

This application claims the priority of German Patent Application Serial No. DE 10 2010 022 150.3, filed May 18, 2010, pursuant to 35 U.S.C. 119(a)-(d), the subject matter of which is incorporated herein by reference.

BACKGROUND OF THE INVENTION

The present invention is in the field of seating devices, especially in the area of a meditation stool.

The present invention refers to a seating device for seating in a kneeling seating position including:

- a seating surface for supporting the buttocks
- a support supporting the seating surface against the floor, and
- a foot rest for supporting the instep of feet resting on the foot rest
- wherein the seating surface, for changing its incline, is able to roll in forward direction via at least one rocker encompassed by the support.

A seating device of a meditation stool is known from the DE 20 2005 003 423 U1. The meditation stool that is described there shows a seating surface close to the floor, supported against the floor by a central column shaped support. The end of the column-shaped support that is supported by the floor is widened in T-shaped manner perpendicular to the seating surface. The meditation stool is for sitting in a kneeling position, wherein the lying instep is supported by a foot rest. In order to avoid disintegration of the intervertebral disc, when seated for hours on the stool, the disclosed seating device makes it possible to conduct small exercise movements. For this purpose, the T-shaped end of the support is curved, such that the seating surface can be slightly tilted in all directions in order to follow the subconscious little movements of the person on the stool by tilting in each of the compensating directions. To stabilize the construction, the column-shaped support is encompassed on all sides by the foot rest, wherein the distance between support and foot rest make small degree compensation movements possible. Additional possibilities for relieving pressure on the intervertebral discs by means of ergonomical adjustments of the seating device are not contemplated with that meditation stool. For easy transport of the seating device, the foot rest can be retracted under the seating surface.

Before this background, it is an aspect of the present invention, to provide a seating device of the afore-stated type, which has improved adjustments to ergonomic requirements of the seated person in order to realize a healthy and comfortable seating on the seating device.

This object is solved by means of the present invention in a seating device of the afore-stated type where the foot rest comprised in the seating device is configured and disposed at the seating device in such a way that, when adjusting the seating device to a ergonomically meaningful angle of the seating surface, the rocker is able to roll in forward direction in an unencumbered through the foot rest.

The invention is based on the realization that a comfortable and healthy seating in kneeling seating position is essentially realized by the individual adjustment of three parameters, namely, seating height, angle of inclination of the seating surface in forward direction and length of the thigh of the seated person. Depending on the length of the thigh of the seated person and predetermined seating height, an angle specific to the seated person between thigh and spine is chosen to upright the pelvis and to allow the spine to be held in a vertical position without force. The seating device according to the invention makes it possible to attain an ergonomically advantageous seating posture by means of a very precise adjustment of the seating surface tilt.

According to the present invention, this angle of the seating position is adjusted from a seating position in a dynamic way in that the tilting angle of the seating surface is adjustable at any time relative to the seating sensation. It is not necessary to leave the seating position in order to change and/or fix the tilting angle. This is based on the realization that an adjustment of the optimal tilting angle of the seating surface is not possible without being seated, as each time a seating position is taken, the effective seating height of the tilted seating surface varies.

When adjusting the tilting angle of the seating surface, a much larger angle area must be accommodated as compared to the movement of the seating surface during the small compensation movements according to the prior art. While the rockers roll in forward direction, the point of support of the rocker can be shifted in this direction. This depends on whether the rocker is supported stationary or movable. In the latter case, the rolling of the rocker across a significantly larger adjustment area of the tilting angle according to the present invention shifts the seating surface in forward direction. This leads to an inconsistent relationship between the seating height and the distance between the point of support of the knee and the point of support of the rocker, such that when adjusting the seating surface tilt by means of the movably supported rocker, this effect is to be taken into account.

It would therefore be desirable and advantageous to provide an improved seating device to obviate prior art shortcomings and to provide a secure, healthy and ergonomic seating device.

SUMMARY OF THE INVENTION

In view of the afore-stated drawbacks, the present invention recognizes that through pressure put on the seating surface that is tilted in forward direction, a shifting of the rocker support point into the starting position can be realized.

Thus according to one aspect of the present invention, a person seated on the seating device, by means of successive tilting and shifting of the seating surface, can adjust the seating surface to an optimal tilting angle of the seating surface.

In accordance with the present invention, the foot rest is constructed and arranged at the seating device so that the rocker can be rolled in forward direction unencumbered due to the foot rest, in order to adjust the seating surface to an ergonomically useful tilting angle. In other words, the foot rest allows for at least one forward extending track, such that the rocker can roll along the track without a stop. Expressed differently, the foot rest does not prevent a tilting of the rocker and the entire support arranged above within a necessary angle range, whereby the necessary angle range is defined through ergonomically useful tilting angle of the seating surface. A delay of the rolling motion due to the foot rest may thus be desirable.

According to a first embodiment of the seating device according to the present invention, the rocker is arranged above the foot rest, such that the support encompasses the at least one rocker and also the associated counter support from which the rocker can roll off. According to a second embodiment of the present invention, the rolling surface of the rocker is on the floor, such that the support that extends between the seating surface and the rocker is carried by the rocker.

According to that embodiment, the seating device can comprise two rockers, which are arranged in a rolling manner to the right and the left of the foot rest. In this case, the kneeling person positioned on the seating device places the feet between the two rockers, which can roll unencumbered, due to the foot rest, in a forward direction. According to a third embodiment the seating device comprises a rocker arranged centrally, which for example, is able to roll by means of a counter support that is formed by the foot rest. This avoids scratching of the floor during the rolling motion of the rocker. In this case it is important that the counter support formed by the foot rest is constructed such that a tilting of the rocker and the entire support arranged above is realized without a stop across the entire necessary angle range, whereby the necessary angle range is defined through the ergonomically useful tilting angle of the seating surface. According to a fourth embodiment, the foot rest is divided into two parts by means of a cut extending in forward direction, wherein between the two parts of the foot rest a rocker is disposed for rolling on the floor. The two parts of the foot rest permit a track extending in forward direction having a width which corresponds at least to the width of the support that moves through the foot rest while the rocker is rolling so that a smooth and unencumbered rolling of the rocker is realized.

A further essential advantage of the present invention is that in addition to the seating device being adjustable relative to the seating surface, the seating device allows dynamic balancing movements around the adjusted angle, so that the intervertebral disks of the seated person are further relieved of pressure.

The curvature of the rocker can be selected so that the seating height during the rockers rolling is approximately constant. According to a fifth embodiment of the seating device, the height of the seating surface can be adjusted separately. Thereby, the angle between thigh and lower leg of the seated person and thus the degree of the knee bend can be varied.

Advantageous embodiments of the present invention are provided in the following description and in the dependent claims, the features of which can be applied in particular as well as in any combination.

A preferred embodiment of the present invention provides that the rocker is movable in forward direction, and the length of the rocker pointing in forward direction is larger than its width.

The configuration of the rocker according to the first feature, the distance between the foot rest and the rocker, is adjustable through shifting the rocker in forward direction. As this distance is adjusted to the seating height and the individual parameters length of the thigh and lower leg, a comfortable and healthy position of the foot on the foot rest is realized. Also, a counter support holding the rocker in fixed position is not necessary.

By configuring the rocker according to the second feature, a small point of support results, so that the rocker can roll or move more easily. In addition, this configuration of the rocker saves weight which allows easier transport of the seating device.

In a kneeling seating position, the width of the rocker does not markedly contribute to a better and more secure seating position. For a better and secure seating position, it is the length of the rocker in forward positions that counts which, upon the forward tilting of the seating surface, also prevents a toppling over of the seating device. It is thus advantageous when the length of the rocker is substantially larger than the width of the rocker. Due to the smaller width of the rocker, a light tilting of the seating surface in perpendicular direction is realized, if the seating device includes one rocker, whereby the seated person can carry out balancing movements in this direction that ease the spine. A curvature of the rocker support surface in perpendicular direction is thus no longer required as compared to the prior art.

It is also viewed as an advantage that the length of the rocker pointing in forward direction corresponds to minimum one half of the length of the seating surface.

In accordance with this configuration of the present invention, the seating surface is supported along at least one half of it length by the rocker. Thereby, the person seated on the seating device can shift the seating position in longitudinal direction relative to the seating surface, without the seating device toppling over either forward or rearward. Thus, the seated person has a greater sense of security and on the other hand, makes it possible to vary the effective seating height by just shifting the seating position. With this, the seating device can be even better adjusted to the ergonomic need of the seated person.

Within the scope of the present invention for determining the length of the seating surface, any extensions of the seating surface which have no function as a seating surface, are ignored In an advantageous variant, it is contemplated that the support perpendicular to the seating surface is configured narrowly, such that the foot rest extends both right and left past the support.

This makes it possible for the seated person to individually choose the horizontal angle between the thigh and the lower leg, without the feet hitting the support.

It can also be of advantage that the seating device comprises exactly one rocker. Thereby, the weight and the measurements of the seating device can be further reduced. The rocker is disposed centrally beneath the seating surface. If the rocker has a suitably small width, a small tilting of the seating surface in perpendicular direction is realized such that the person seated on the seating device can make small balancing movements in that direction.

An especially robust and simple construction of a preferred embodiment of the present invention contemplates that the rocker is extended in U-shape by means of two legs, whereby the ends of each of the legs are successively connected to the seating surface in forward direction.

In addition to the robust and simple construction, the foregoing configuration has the advantageous that a foot rest which extends to the right and to the left of the rocker can be connected through the opening of the U-shaped rocker, so that the rocker despite this connection can roll unencumbered due to the foot rest.

According to a fifth embodiment of the present invention, the legs are rigidly connected to the seating surface. According to a sixth embodiment of the present invention, for the separate adjustment of the seating height, the legs are connected to the seating surface via a connecting means that is adjustable.

It is further advantageous that the foot rest supporting the instep of the feet is an upholstered longitudinal body to be disposed crosswise to the seating surface.

A foot rest that is configured in that manner includes especially small measurements. The body of the foot rest can simply have an upholstered surface, or it can be made entirely of soft material. In accordance with one embodiment, that body is made of foam core covered with fabric material. This is particularly light weight. The foot rest disposed perpendicular to the seating surface, for example, is connected removable or unremovable with the seating device. The foot rest can be disposed so that the at least one rocker can roll unencumbered because of the foot rest and the foot rest extends perpendicular to the seating surface. The longitudinal body can be configured as either a unitary piece or can be configured as several pieces.

In a further advantageous variant of the present invention, the foot rest has a substantially semi-circular cross section. Thus, the foot rest points upwardly with the curved side, so that a person kneeling in seated position on the seating device can comfortably position the feet with the instep pointing downward at the curved side of the foot rest. The semi-circular cross section of the foot rest realizes an especially healthy position of the feet resting on the foot rest.

It can also be advantageous that the foot rest is divided once across so that the rocker is disposed between the two partial sections, so that the rocker sweepingly rolls through the foot rest.

According to this embodiment, the rolling motion of the rocker is delayed by the foot rest but not encumbered. According to one embodiment, the foot rest is crosswise divided into two separate parts by means of a forward extending cut. According to a further embodiment, the two parts are not entirely separated by the forwardly extending cut, so that the cut forms only a deep groove in the foot rest. The rocker is disposed between the two partial sections. The rocker is arranged between the two partial sections so that the rocker side surfaces pointing crosswise adjoin at least partially the front faces of the partial sections that are facing each other, so that the rocker can roll sweepingly through the foot rest. The rolling motion of the rocker is carried out against a frictional resistance which is generated by the contact of the rocker side surfaces with the front faces of the partial sections. This results in the slower rolling motion of the rocker, in order to realize a more precise adjustment of the seating surface tilt. Moreover, if the seating device includes only one rocker, this configuration prevents a sideways toppling of the seating surface when leaving the seating device.

It can also be advantageous that the two partial sections are connected via at least one connecting means which extends through an opening in the support.

The frictional resistance that slows down the rolling motion of the rocker can be increased by means of the length of the connecting means. According to one embodiment, the connecting means are elastic. The size and the shape of the opening in the seating device are to be selected so that the rocker can roll unencumbered by the foot rest.

In a further advantageous embodiment, it is contemplated that the foot rest is lifted up to under the seating surface, so that both ends of the foot rest are foldable vertically in downward direction into a transport position. In this folded position, the seating device has favorable measurements for transport.

It is furthermore advantageous that the foot rest is removably disposed at the seating device for separate usage of the foot rest. For example, the foot rest can be utilized independent of the seating device, as support for the head or a knee of a person lying down.

The features as recited in the claims refer, unless otherwise stated, to a seating device mode of seating a person. The present invention encompasses also those seating devices which exhibit at least one other mode or operation or one other mode of transport where those features are not necessarily realized.

The seating device according to the present invention is configured for seating in a kneeling position. According to one embodiment, the seating device can have a seating surface close to the floor, such that knees and feet of the seated are at the floor level. The scope of the present invention encompasses also those embodiments of seating devices that merely extend the height of the seating surface. For example, such a seating device could be mounted on a platform.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
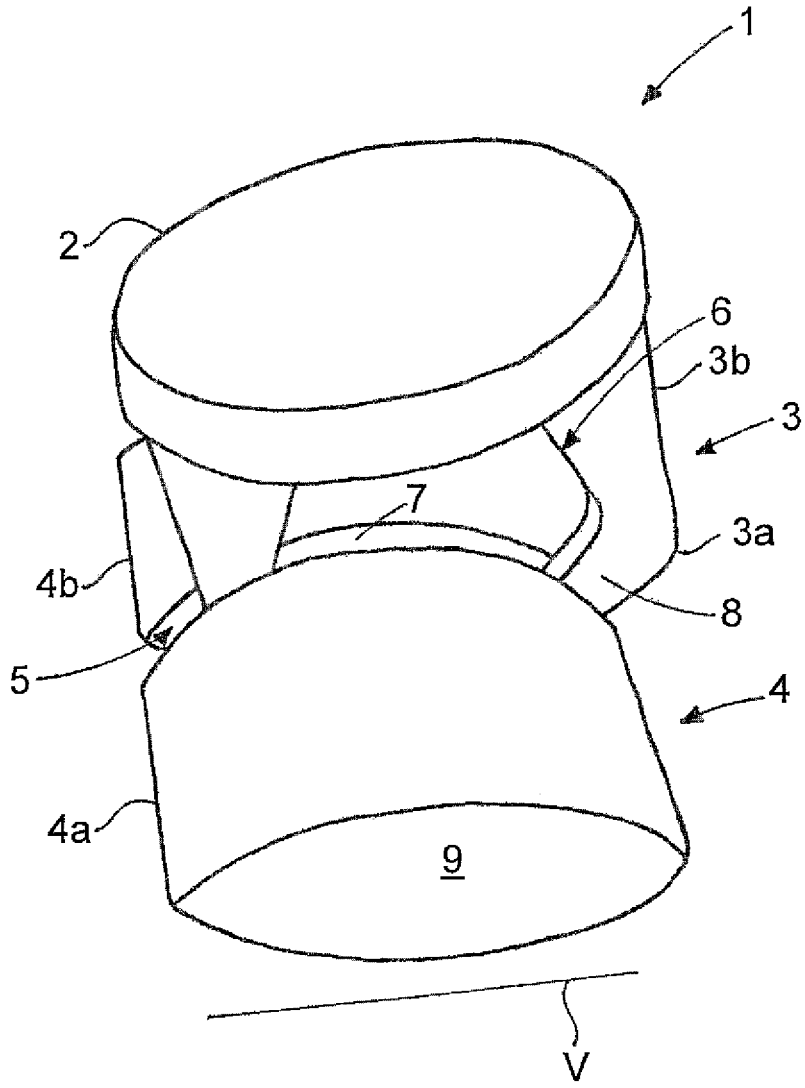
FIG. 1 is a top and side perspective view of an embodiment of the seating device according to the present invention.

Throughout all the Figures, same or corresponding elements are generally indicated by same reference numerals.

Turning now to the drawing, and in particular to FIG. 1, there is shown an embodiment of the seating device 1 according to the present invention including a seating surface 2 and support 3 which supports the seating surface 2 against the floor. The support 3 includes exactly one rocker 3*a* for rolling off the floor, whose length pointing in forward direction V is substantially larger than the width of the rocker. The length of the rocker 3*a* corresponds approximately to the length of the seating surface 2. The rocker 3*a* extends through two legs 3*b* in U-shape, wherein the ends of the legs 3*b* are successively connected with the seating surface 2 in forward direction. The rocker 3*b* and portions of the legs 3*b* are disposed between two partial sections 4*a*, 4*b* of a foot rest 4.

The foot rest 4 is a longitudinal body disposed crosswise to the seating surface 2 with the cross section of the body essentially semi-circular shaped. The foot rest 4 is divided exactly once across with the rocker 3*a* disposed between partial sections 4*a*, 4*b*. The support 3 is configured narrowly crosswise to the seating surface 2, such that the foot rest 4 projects past the support 3 at the right and at the left.

Figure 3:
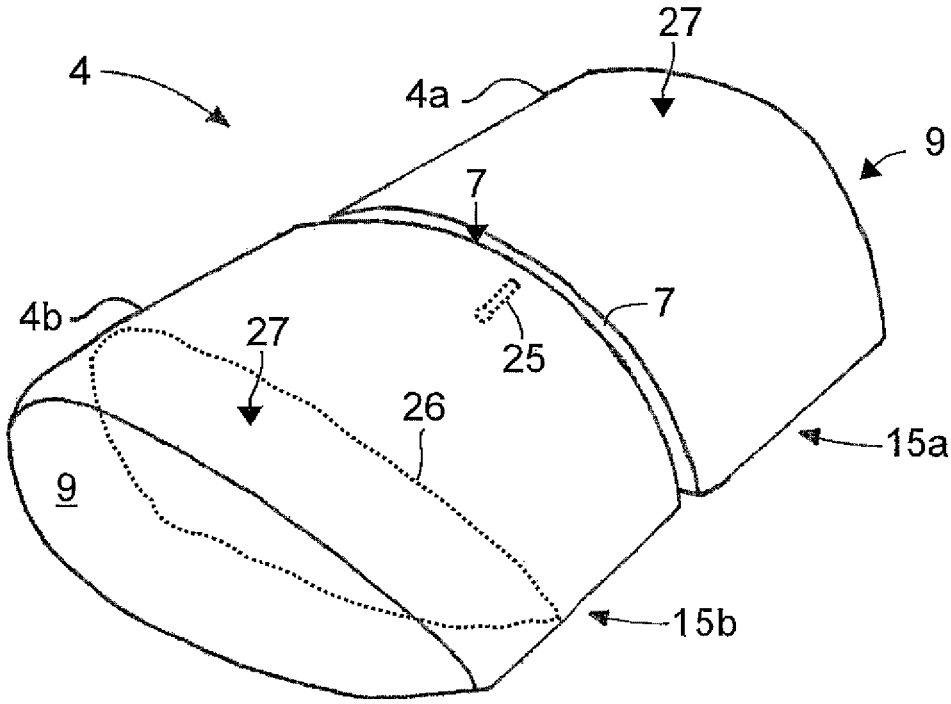
FIG. 3 is a side and perspective view of the foot rest of the embodiment of the seating device in FIG. 1.

The foot rest 4 is configured and disposed at the seating device 1 in such a manner that the rocker 3*a* can roll unencumbered in forward direction V due to the foot rest 4, in order to adjust an ergonomically suitable tilting angle of the seating surface 2. The foot rest 4 thus leaves free a forward leading track 5 so that the rocker 3*a* can roll along the track 5 without any stop. The foot rest 4 does not prevent a tilting of the rocker 3*a* and the leg 3*b* located above the rocker 3*a*, so that the tilting of the seating surface can be adjusted within a certain ergonomically suitable angle range. In order to facilitate adjustment of the angle and to prevent the toppling over of the seating surface 2 in perpendicular direction, the two partial sections 4*a*, 4*b* are connected to each other via connecting means as seen in FIG. 3. The connecting means extend through the opening 6 of the U-shape and draws on the front sides 7 of partial sections 4*a*, 4*b* at the side surfaces 8 of the rocker 3*a*, so that upon the rolling movement of rocker 3*a* carried out against a frictional resistance, the rocker 3*a* sweeps through the foot rest 4. The opening 6 of the U-shape has a size and shape such that the connecting means surrounded by the foot rest 4, does not prevent a rolling and shifting of the rocker 3*a* in forward direction V. For transporting the seating device 1, the foot rest 4 can be lifted up to underneath the seating surface 2, in order to fold the partial sections 4*a* 4*b* at the support vertically downwards with the side surfaces 9 in direction of the floor. In this transport position, the seating device 1 is cylinder shaped. In order to utilize the foot rest 4 separately from the seating device 1, the foot rest 4 can be separated from the seating device 1. For example the connecting means disposed between the partial sections 4*a* and 4*b* can be detached. If the foot rest 4 consists of a soft material, the foot rest 4 can also be detached from the seating device 1, by pulling the foot rest 4 through the opening 6.

Figure 2:
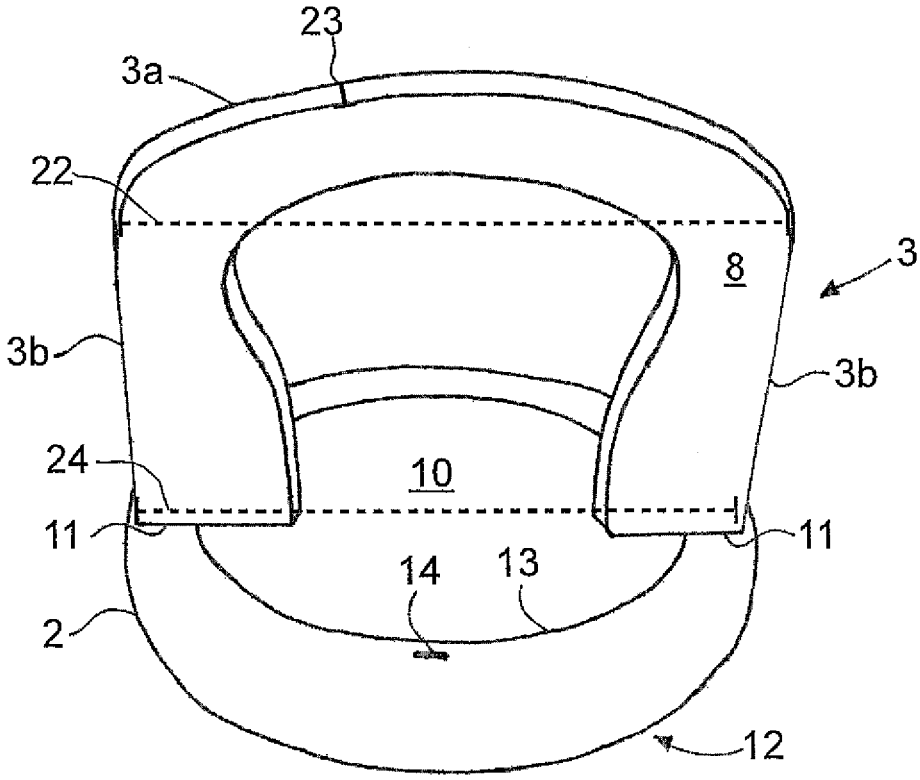
FIG. 2 is an oblique perspective view of the bottom side of the seating surface and the support of the embodiment of seating device in FIG. 1.

FIG. 2 shows the seating surface 2 and the support 3 of the seating device as shown in FIG. 1 in a single depiction obliquely from below. The seating surface 2 sits head down on the floor, so that the seating bottom side 10 can be seen. The support 3 is fastened to the seat bottom side, 10, and comprises one rocker 3*a* and two legs 3*b* extending rocker 3*a* in an U-shaped manner. Rocker 3*a* has a length 22 and a width 23. The side surfaces 8 of rocker 3*a* is flat formed based on the board shaped configuration of the support 2. The ends 11 of the legs 3*b* are fastened at seat bottom 10 of seating surface 2. For example, the ends of legs 3*b* are screwed together with seating surface 2. The seating surface 2 has a seating surface length 24 which corresponds approximately to the length 22 of rocker 3*a*. The upper surface 12 of seating surface 2 is upholstered. A foam core is placed on the hard top of the seating surface 2 which is then covered with suitable fabric material 13 and fixed with fixing means 14 at the seating bottom side 10.

FIG. 3 shows the foot rest 4 in the seating device as shown in FIG. 1 in an illustration obliquely from above. The longitudinal body of the foot rest 4 is divided across into partial sections 4*a* and 4*b*. Extended between the partial sections 4*a* and 4*b* is the connecting means, which connects the two partial sections with each other, whereby the connecting means 25 would extend through the opening 6 at the support 3 in the arrangement of the foot rest 4 in an embodiment as seen in FIG. 1. The foot rest 4 detached from the seating device 1 has also other utility due to the semi-circular cross section 26 and the soft surface. In the embodiment as shown, the embodiment can be used as a head rest or as support for a knee by a person lying down. If placing the undersides 15*b*, 15*a* next to each other, a double size bolster results. This can for example be used as a back support. In this position, the undersides 15*a*, 15*b* facing each other, the foot rest 4 disposed at the seating device 1 would be in a transport position. For this, the foot rest 4 is lifted up to the seating surface 2 in the seating device 1 as shown in FIG. 1 and then folded with both ends 27 vertically downward so that the side surfaces 9 of the foot rest 4 is pointing in the direction of the floor and the front sides 7 of the foot rest 4 in the direction of the seating surface 2.

Figure 4:
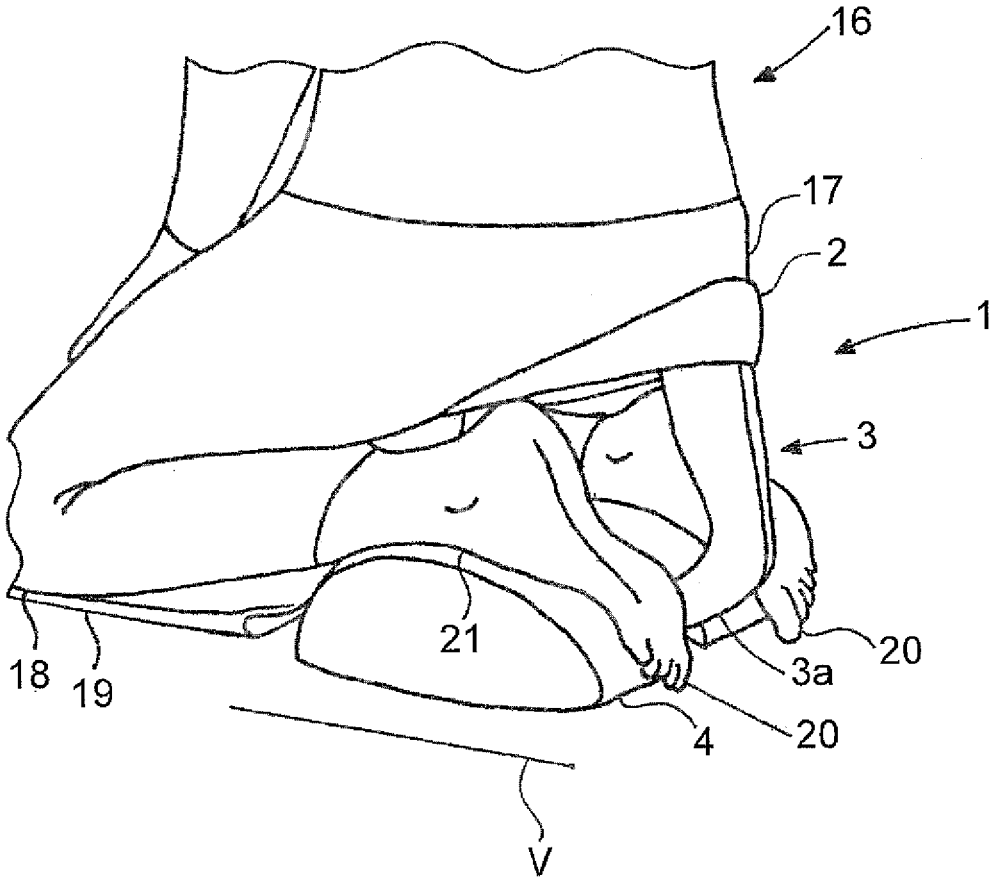
FIG. 4 is a perspective side view of a detail of the embodiment of the seating device in FIG. 1 shown with a seated person.

FIG. 4 shows a detail of the seating device 1 according to the present invention corresponding to the embodiment as shown in FIG. 1 together with a person 16 sitting on the seating device 1. Person 16 sits in a kneeling seated position on the seating device 1. The person's buttocks 17 are on the seating surface 2. The knees 18 of person 16 are placed on the floor or on a thin blanket 19 placed on the floor. Feet 20 are laying on the foot rest 4, whereby the foot rest 4 supports the instep 21 in lying position. Seating surface 2 is supported against the floor by support 3. By rolling off the floor, the rocker 3*a* encompassed by the support 3, the tilting of the seating surface 2 can be adjusted by the person 16 from the seated position. By means of the rolling and shifting of the rocker 3*a* in forward direction V, person 16 can find an optimal tilting angle of the seating surface 2 and an optimal distance between foot- and rocker support point. Within the scope of the present invention, the forward direction is a group of parallel directions. The rolling and shifting of rocker 3*a* in the forward direction encompasses thus a forward and backward motion.

Figure 5:
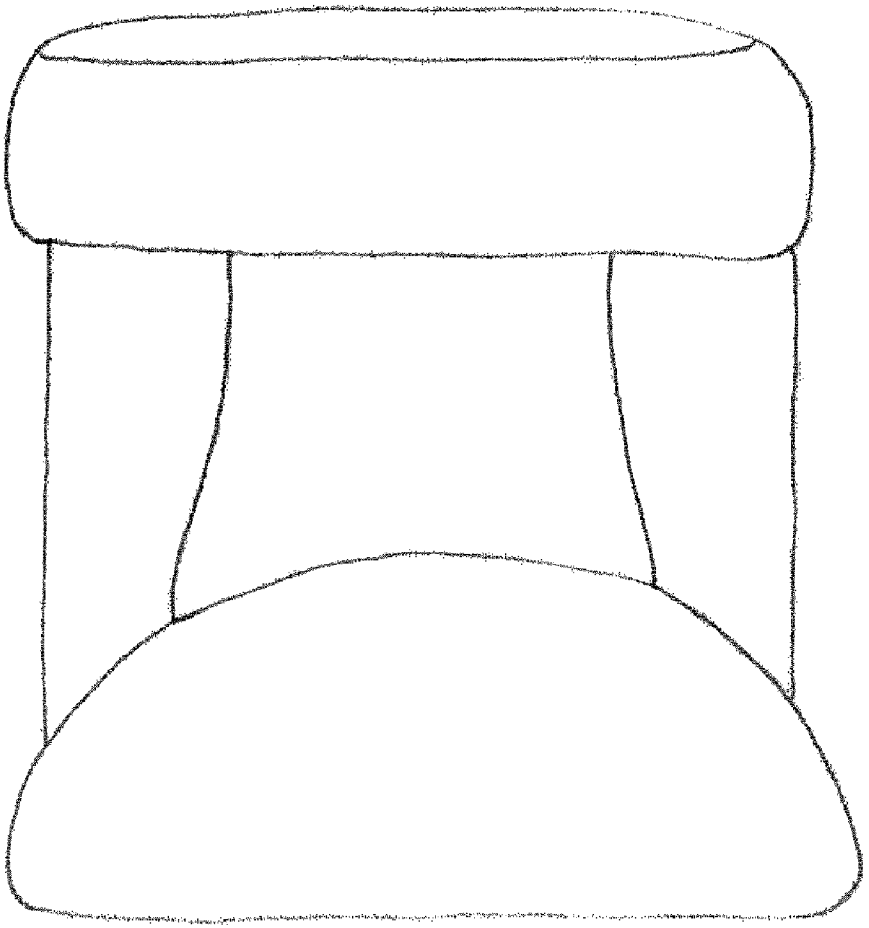
FIG. 5 is a side view of the embodiment of the seating device according to the present invention, with an upholstered seating surface and upholstered foot rest.

FIG. 5 shows another embodiment of the seating device according to the present invention in a side view. Both the foot rest 4 and the seating surface are upholstered with a felt-type fabric material 13. The rocker 3*a*, 3*b* made from wood are shown from a side perspective.

Figure 6:
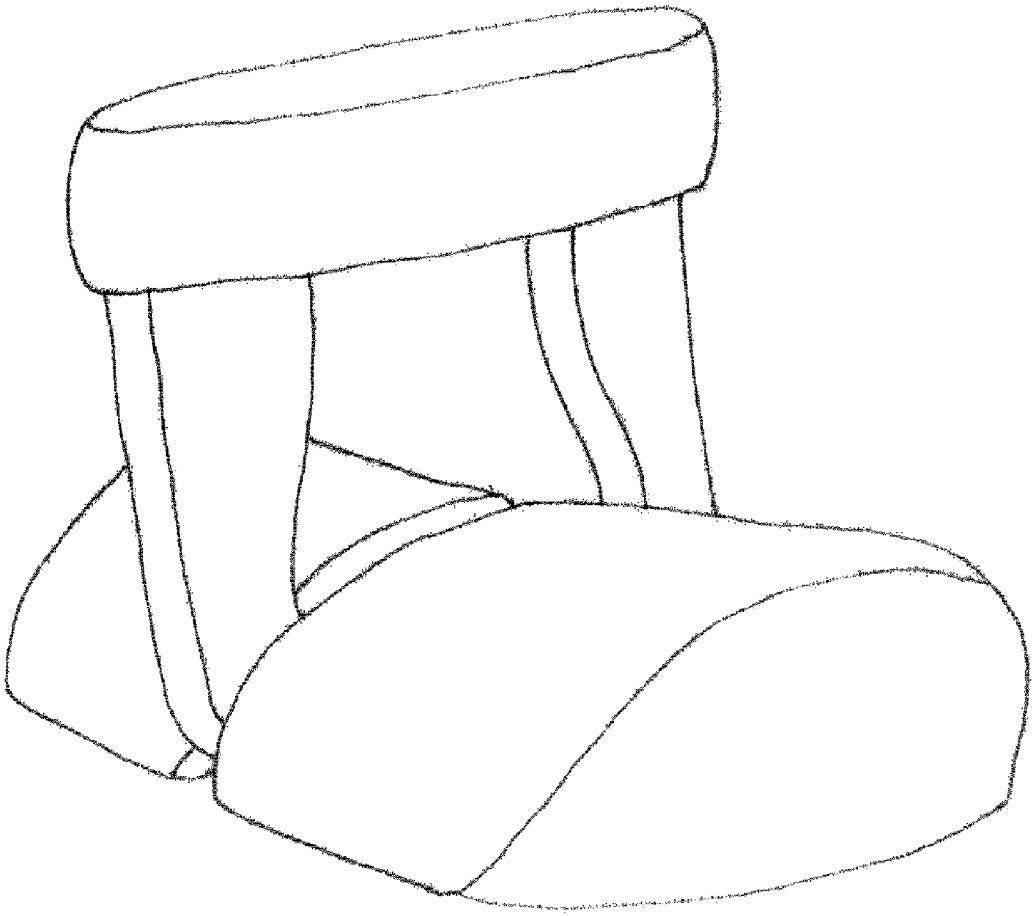
FIG. 6 is a front side perspective view of the embodiment shown in FIG. 5.
Figure 7:
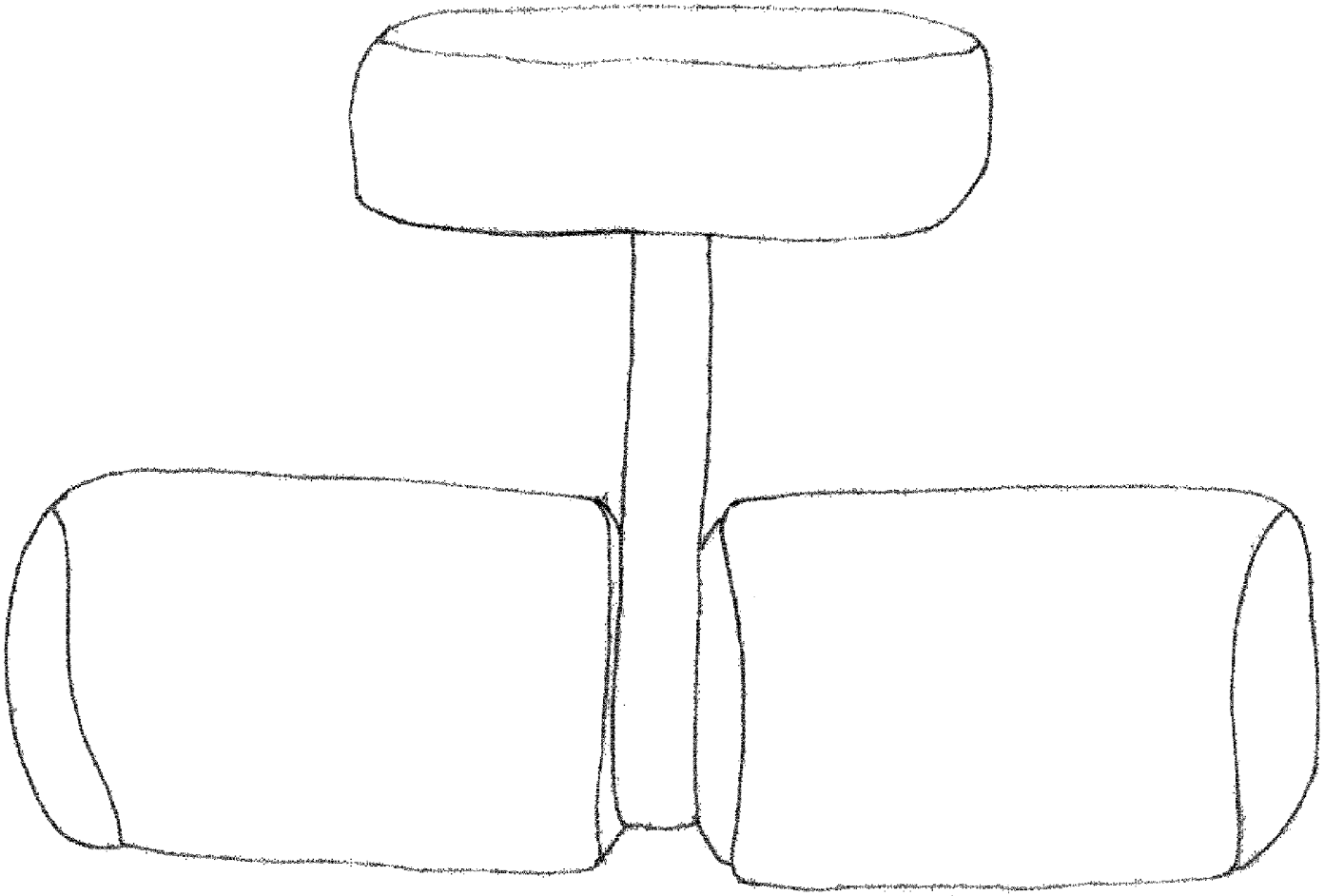
FIG. 7 is a rear elevational view of the embodiment of the seating device in FIG. 5.
Figure 8:
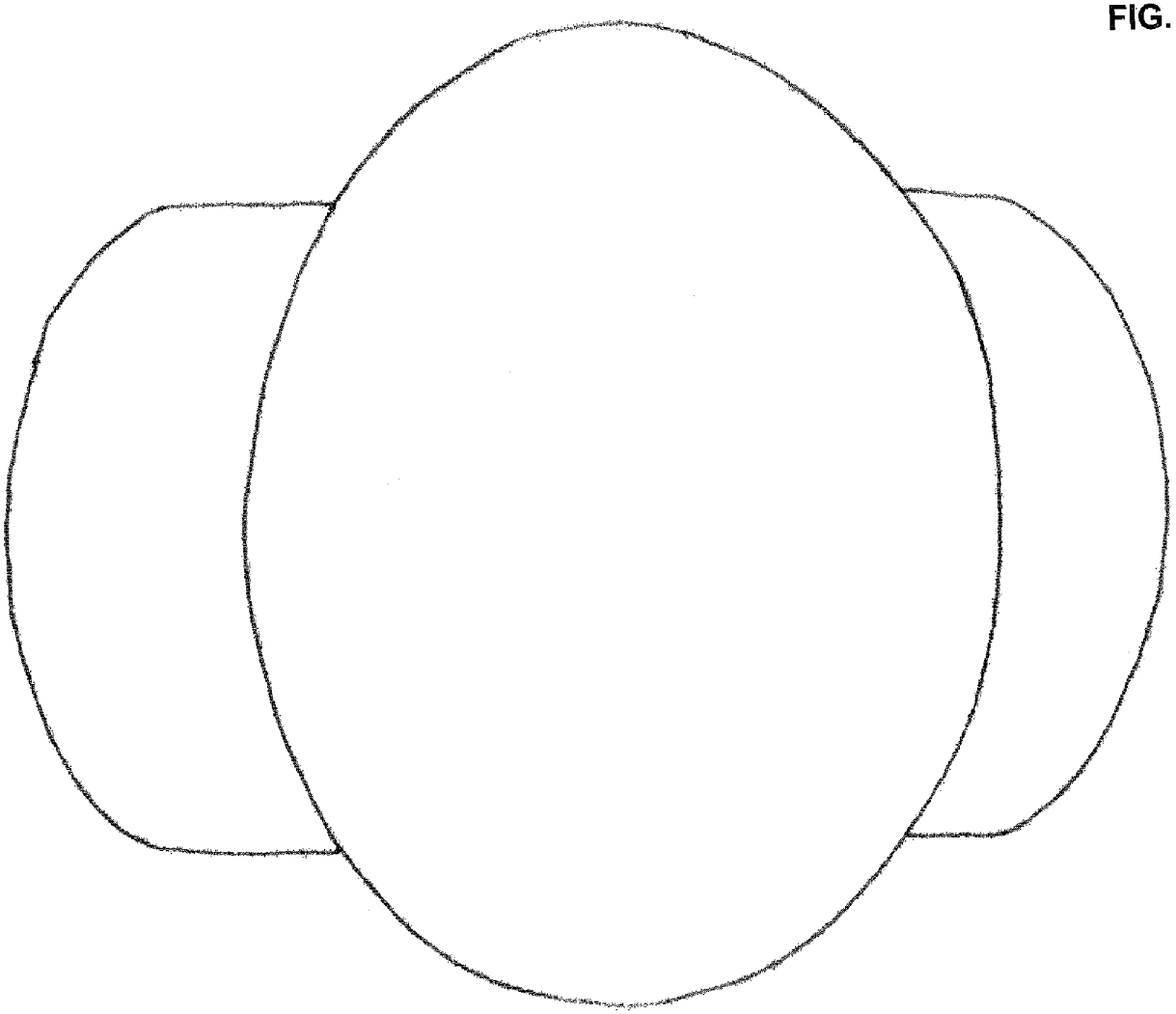
FIG. 8 is a top plan view of the embodiment of the seating device in FIG. 5.

FIG. 6 shows the same embodiment as FIG. 5 where the seating surface 2 is now tilted in forward direction. FIG. 7 shows the same embodiments in a rear view where the seating surface is in upright position. The rocker 3*a*, 3*b* seen by the front side 30 has a series of grooves 31 in the front side 30 and the support 3 where it is in contact with the floor includes a band of rubber 32 which extends through the curvature of the support 3. FIG. 8 is a top view of the seating device 1 showing clearly the upholstered portions of the seating surface 2 and the foot rest 4.

While the invention has been illustrated and described as embodied in a seating device, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents.

What is claimed is:

1. A seating device for sitting in a kneeling seating position comprising:

a substantially rounded seating surface for supporting buttocks of a person, a support connected to the seating surface, a foot rest for supporting an instep of feet placed on the foot rest;

wherein the support is constructed in a generally U-shaped configuration including two vertical legs bordering an opening, and a curved portion connecting the two legs; wherein the curved portion acts as a rocker capable of rolling on a floor; wherein the legs have a dimension such that when viewing the U-shaped support from the side, the width of the legs is generally greater than a thickness of the legs; wherein the foot rest is divided into two partial sections with the U-shaped support disposed between the partial sections such that the legs of the support are oriented in successive order one behind the other for movement between the two partial sections of the foot rest; wherein changing a tilting angle of a the seating surface a forward direction is carried out by the person seated on the seating surface by rocking the rocker against the floor such that the rocker is able to roll in forward direction unencumbered through the foot rest in order to provide an ergonomic tilting angle of the seating surface.

2. The seating device of claim 1, wherein the rocker on its curved portion is covered with a rubber surface.

3. The seating device of claim 1, wherein the rocker is wider at an upper end and tapering to a lower end.

4. The seating device of claim 1, wherein the two partial sections are connected to each other by connecting means extending through the opening.

5. The seating device of claim 1, wherein both the seating surface and the foot rest each are upholstered for cushioning and covered with a soft fabric.

* * * * *

UNITED STATES PATENT AND TRADEMARK OFFICE

CERTIFICATE OF CORRECTION

PATENT NO. : 8,465,099 B2
APPLICATION NO. : 13/109746
DATED : June 18, 2013
INVENTOR(S) : Stephan George Ayikwei Addy It is certified that error appears in the above-identified patent and that said Letters Patent is hereby corrected as shown below:

In the Claims:

Col. 8, line 67 change "surface a forward" to --surface in a forward--
Col. 9, line 2 change "in forward direction" to --in a forward direction--

Signed and Sealed this
Third Day of September, 2013

Teresa Stanek Rea
*Acting Director of the United States Patent and Trademark Office*